US005894962A

United States Patent [19]

Song et al.

[11] Patent Number: 5,894,962

[45] Date of Patent: Apr. 20, 1999

[54] SODA BOTTLE CAP

[76] Inventors: Jerng-Sik Song; Chung-Hwa Song; Christopher Chan-Woo Song; Teresa Won-Kyung Song, all of DoHwa-1-dong, MaPo-gu, Seoul, Rep. of Korea, 121-041

[21] Appl. No.: 08/875,753

[22] PCT Filed: Feb. 5, 1996

[86] PCT No.: PCT/KR96/00015

§ 371 Date: Aug. 1, 1997

§ 102(e) Date: Aug. 1, 1997

[87] PCT Pub. No.: WO96/24553

PCT Pub. Date: Aug. 15, 1996

[30] Foreign Application Priority Data

Feb. 6, 1995 [KR] Rep. of Korea ..... 95-2033

[51] Int. Cl.[6] ..... B65D 37/00

[52] U.S. Cl. ..... 222/213; 222/394; 222/464.3

[58] Field of Search ..... 222/212, 213, 222/464.3, 541.6, 394

[56] References Cited

U.S. PATENT DOCUMENTS 3,563,413 2/1971 Gordon ..... 222/213 X 3,595,445 7/1971 Buford ..... 222/213

*Primary Examiner*—Gregory L Huson

*Attorney, Agent, or Firm*—Richard B. Klar, Esq.

[57] ABSTRACT

This present invention relates to a soda bottle cap having a shell with a spout and a flexible top, and a seal that has an opening through which liquid can flow out when the flexible top is pressed down. With the structure of this soda bottle cap it is possible to release the carbonated liquid from the soda bottle using the high pressure of $CO_2$ gas inside. When the flexible top is pressed down, the seal changes shape and does not block inner hole (6) so that the liquid in the bottle can be pushed out through the tube(12), and then through the center hole(9) of the seal, and then through channels (10) of the seal, and then through the inner hole (6) of the shell, and then through the spout (4) by the inner hole (6) of the shell, and then through the spout (40 by the high pressure of CO gas in the bottle. When the force on the flexible top (7) is released after use, the flexible top and the seal go back to its original shape.

7 Claims, 10 Drawing Sheets

SODA BOTTLE CAP

BACKGROUND OF THE INVENTION

1. Field of the Invention

This invention relates to soda bottle cap of simple structure that enables discharge of liquid from a soda bottle while keeping high pressure gas inside to maintain the carbonated taste of liquid until it is consumed.

2. Background

Because the commonly used cap for soda bottle that contains carbonated liquid, such as cola, cider, and beer, is simply made of shell (1) and seal (2) as is shown in FIG. 1, the cap should be removed from the bottle (3) before the liquid can be poured from the bottle. As soon as the cap is opened, the high pressure $CO_2$ gas inside the bottle is released from the bottle. When the cap is closed after use, the space above the carbonated liquid is slowly pressured again by the $CO_2$ released from the carbonated liquid inside the bottle. When the cap is opened again to pour out the liquid from the bottle, the high pressure $CO_2$ gas is lost again as this opening and closing of the cap is repeated, the $CO_2$ gas that is dissolved in the carbonated liquid is lost repeatedly, the carbonated taste of carbonated liquid becomes weak, and the liquid turns stale and flat.

To avoid such problems the soda bottle cap of this invention enables release of liquid from a soda bottle while keeping high pressure up. The soda bottle cap of this invention can be manufactured easily for lost cost as it has simple structure and, therefore, can be used widely on soda bottles for general consumers.

SUMMARY OF THE INVENTION

The basic structure of soda bottle cap of this invention consists of a shell that has a spout and a flexible top, and a seal that has an opening through which liquid can flow out when the flexible top is pressed down. The detailed description of the invention is presented referring to figures as follows.

DETAILED DESCRIPTION OF THE PREFERRED EMBODIMENTS

Figure 1:
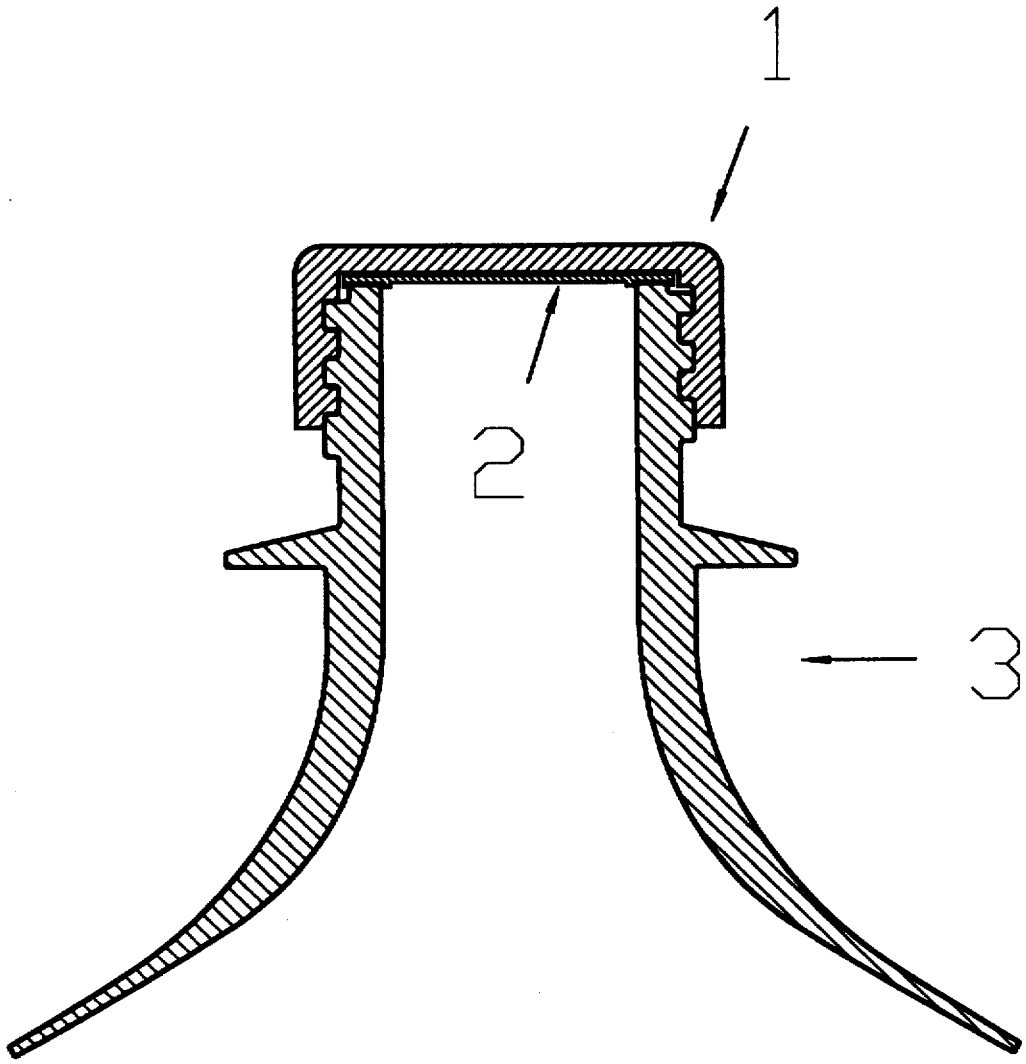
FIG. 1 is a common soda bottle cap. It is simply made of a shell and a seal, and is placed on a soda bottle.
Figure 2:
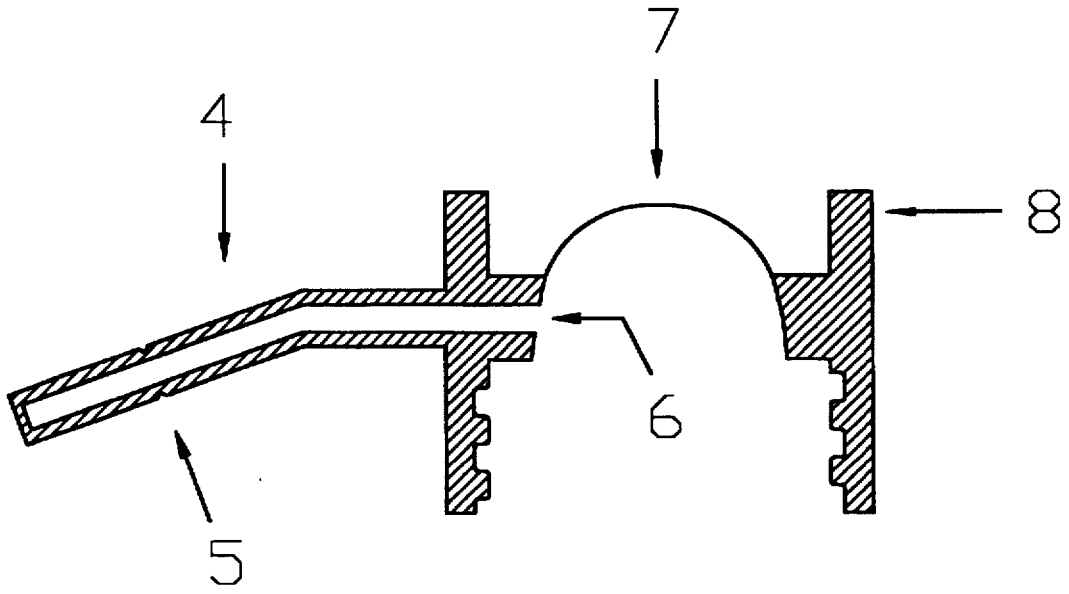
FIG. 2 is an illustration of a first embodiment of the present invention disclosing the shell of the soda bottle cap which has an inner hole (6) which connects to a spout (4), through which liquid can flow out, a flexible top (7) that can be pressed down, and a protective shoulder (8) around the flexible top that keeps the flexible top from being pressed down accidentally during handling.

FIG. 2 shows one example of the shell of the soda bottle cap of the invention. The shell has an inner hole (6) which connects to a spout (4), through which liquid can flow out, a flexible top (7) that can be pressed down, and a protective shoulder (8) around the flexible top that keeps the flexible top from being pressed down accidentally during handling. As the spout has a closed end, it should be broken at the notch (5) before it can be used.

Figure 3:
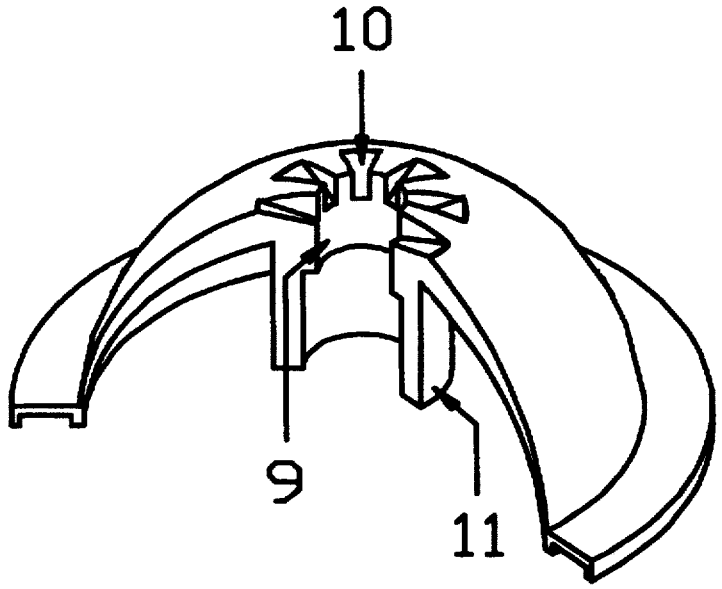
FIG. 3 illustrates a part of the seal that is cut away so that the structure of the seal can be better apprehended. The top of the seal has channels (10) through which liquid can flow. The seal also has a center hole (9) and a tube holder (11) that can hold a tube.

FIG. 3 is one example of the seal of the soda bottle cap of the invention. In the drawing, a part of the seal is cut away so that the structure of the seal can be better apprehended. The seal has channels (10), a center hole (9), and a tube holder (11) that can hold a tube. Liquid can flow out through the center hole (9), and then through the channels (10) of the seal.

Figure 4:
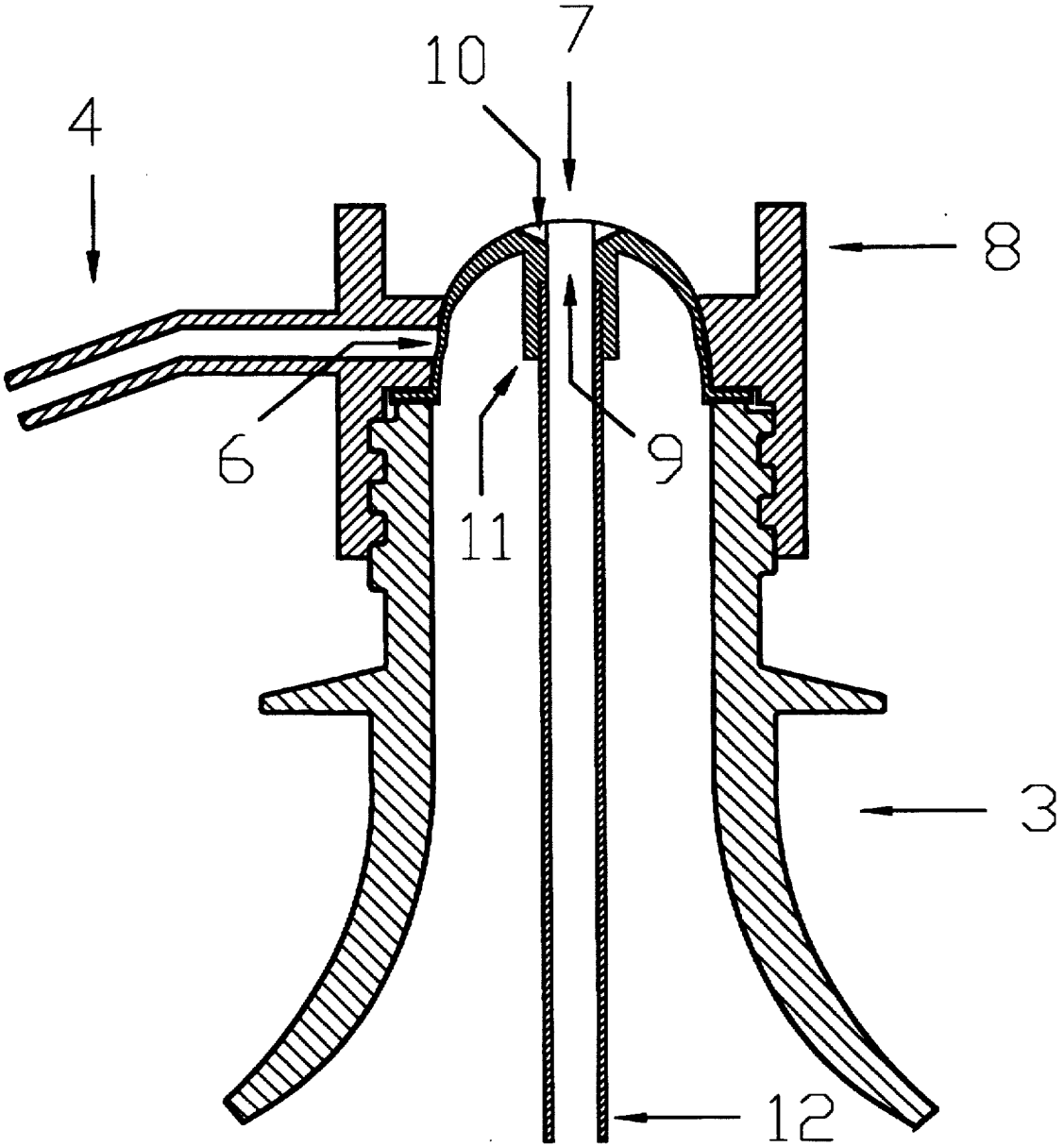
FIG. 4 shows the shell and the seal, placed on a soda bottle. Though the spout (4) is open, as the end of it is broken along notch (5), the liquid can not be discharged from the bottle because the seal is pressed tightly against the inner hole (6) of the shell due to the high pressure of $CO_2$ gas in the bottle.

FIG. 4 shows the soda bottle cap, comprising a shell and the seal, placed on a soda bottle. Though the spout (4) is open, as the end of it is broken along the notch (5), the liquid can not be discharged from the bottle because the seal is pressed tightly against the inner hole (6) of the shell due to the high pressure of $CO_2$ gas in the soda bottle.

Figure 5:
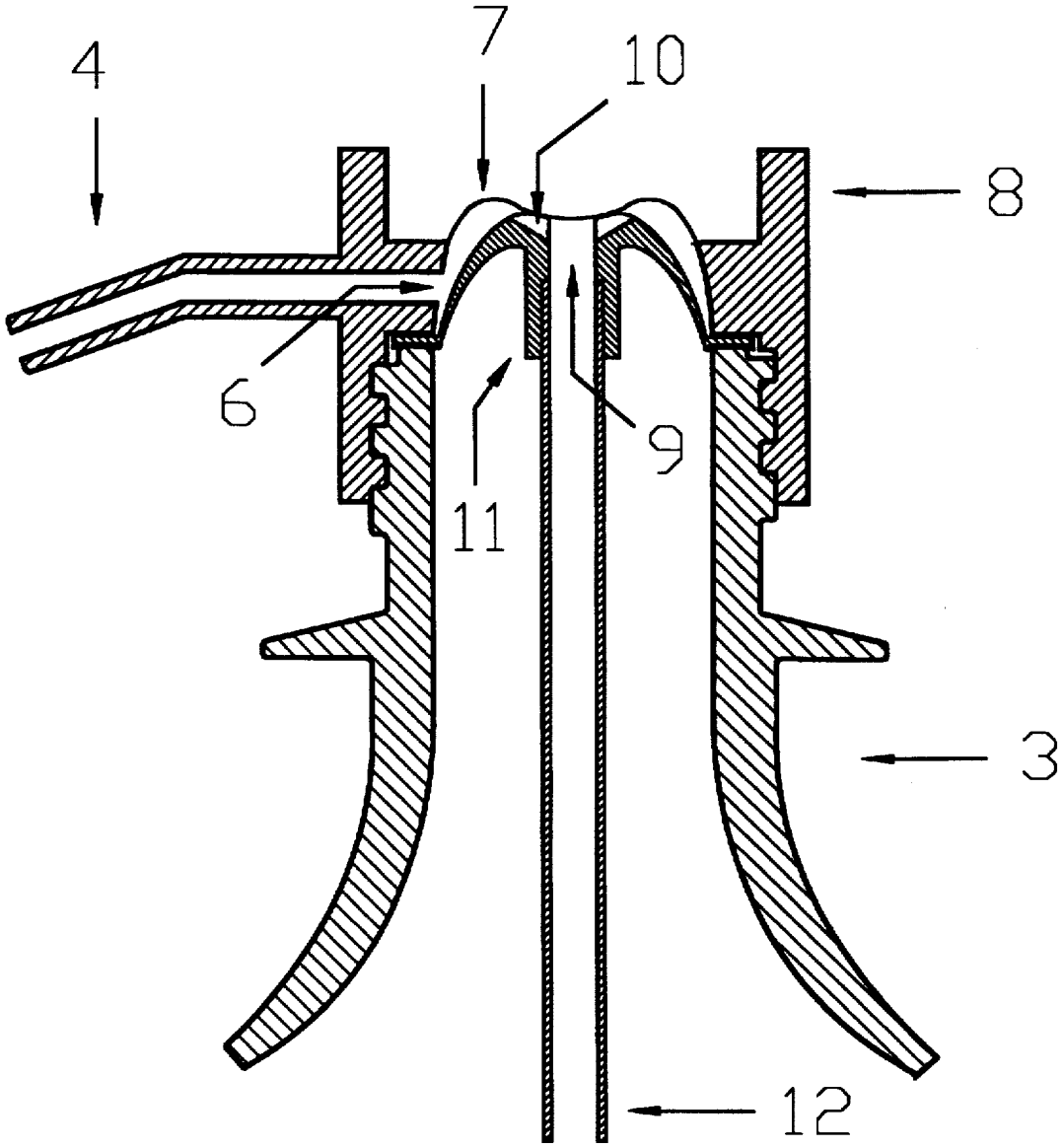
FIG. 5 illustrates the shape change of the soda bottle cap of FIG. 4, when the flexible top (7) of the shell is pressed down. As the seal does not block the inner hole (6) of the shell any more, the liquid in the soda bottle can be pushed out by the high internal pressure of the bottle.

FIG. 5 shows the shape change of the soda bottle cap when the flexible top (7) of the shell is pressed down. As the seal does not block the inner hole (6) of the shell any more, the liquid in the soda bottle can be pushed out through the tube (12), and then through the center hole (9) of the seal, and then through the channel (10) of the seal, and then through the inner hole (6) of the shell, and then through the spout (4) of the shell by the high internal pressure of the bottle.

When the flexible top (7) of the shell is not pressed down any more, the flexible top and the seal go back to the original shape due to their own elasticity and due to internal pressure, and then the seal is pressed tightly against the inner hole (6)

of the shell due to the high pressure of $CO_2$ gas in the soda bottle, and the liquid can not flow any more.

Figure 6:
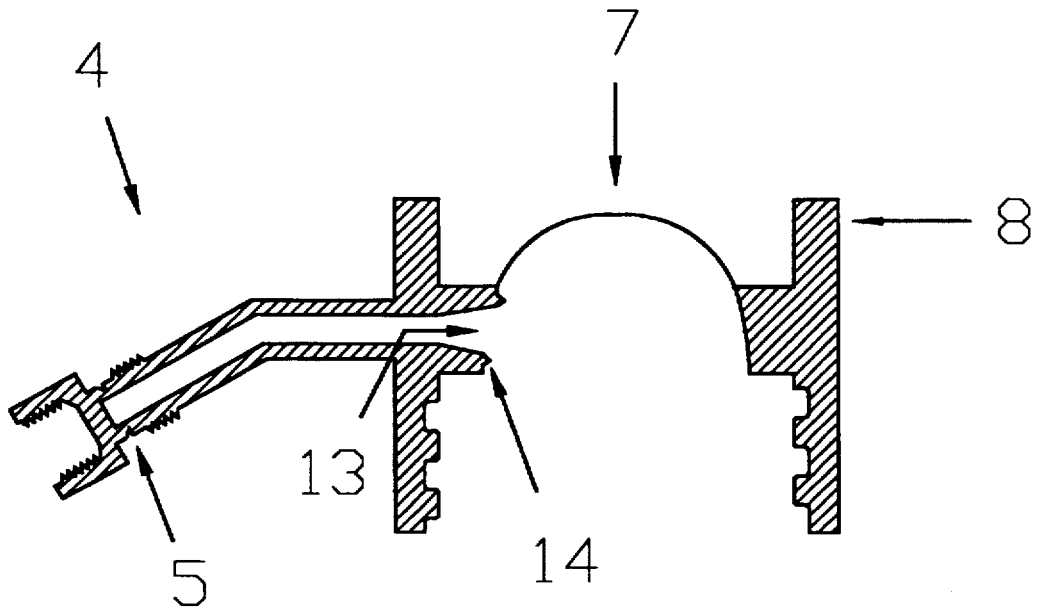
FIG. 6 illustrates another embodiment of the shell of the soda bottle cap of the present invention in which it has a wider inner hole (13) and a ridge (14) around the wider inner hole. Also the spout of this shell has a spout cap at the end, and a thread near the notch (5).

FIG. 6 shows another example of the shell of the soda bottle cap of the invention, which has a wider inner hole (13) and a ridge (14) around the wider inner hole. Because the wider inner hole (13) is bigger than the previous inner hole (6), the seal receives larger force from the high pressure $CO_2$ gas. Because of the wider diameter of the wider inner hole (13) and the ridge (14), the seal can block the wider inner hole (13) more effectively. Also the spout of this shell has a spout cap at the end, and a thread near the notch (5). After the spout cap is detached along the notch, it can be used to close the spout for further safekeeping.

Figure 7:
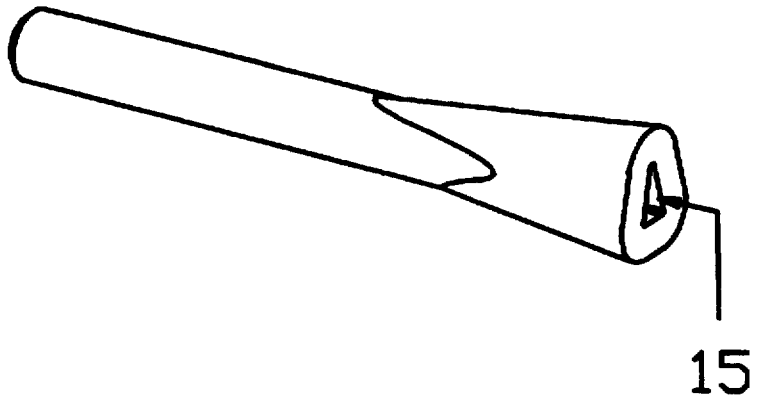
FIG. 7 illustrates another embodiment of the spout in which has a triangular inner hole (15).

FIG. 7 shows separately another example of the spout that has a triangular inner hole (15). With the triangular inner hole it is easier to control the flow of liquid as the triangular inner hole starts to open more slowly than the circular inner hole when the seal bends down and separates itself from the inner hole.

Figure 8:
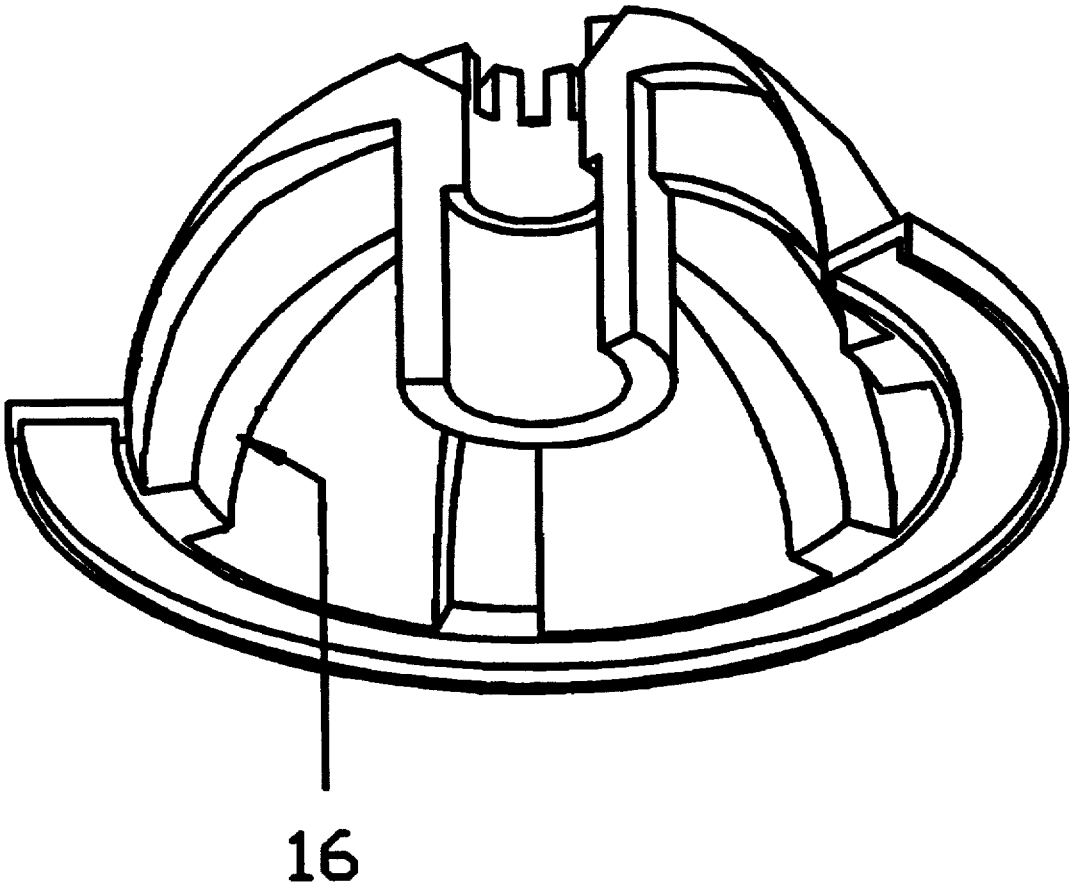
FIG. 8 illustrates another embodiment of the seal that has ribs (16) where a part of the seal is cut away so that the structure of the seal can be better apprehended. Due to the ribs (16) the seal can return to the original state more readily when force on the flexible top (7) is released.

FIG. 8 shows another example of the seal that has ribs (16). In the drawing, a part of the seal is cut away so that the structure of the seal can be better apprehended. Due to the ribs (16) the seal can return to the original state more readily when force on the flexible top (7) is released. With the ribs the part of the seal where it contacts with the inner hole of the shell can be made thinner to have better contact with the inner hole.

Figure 9:
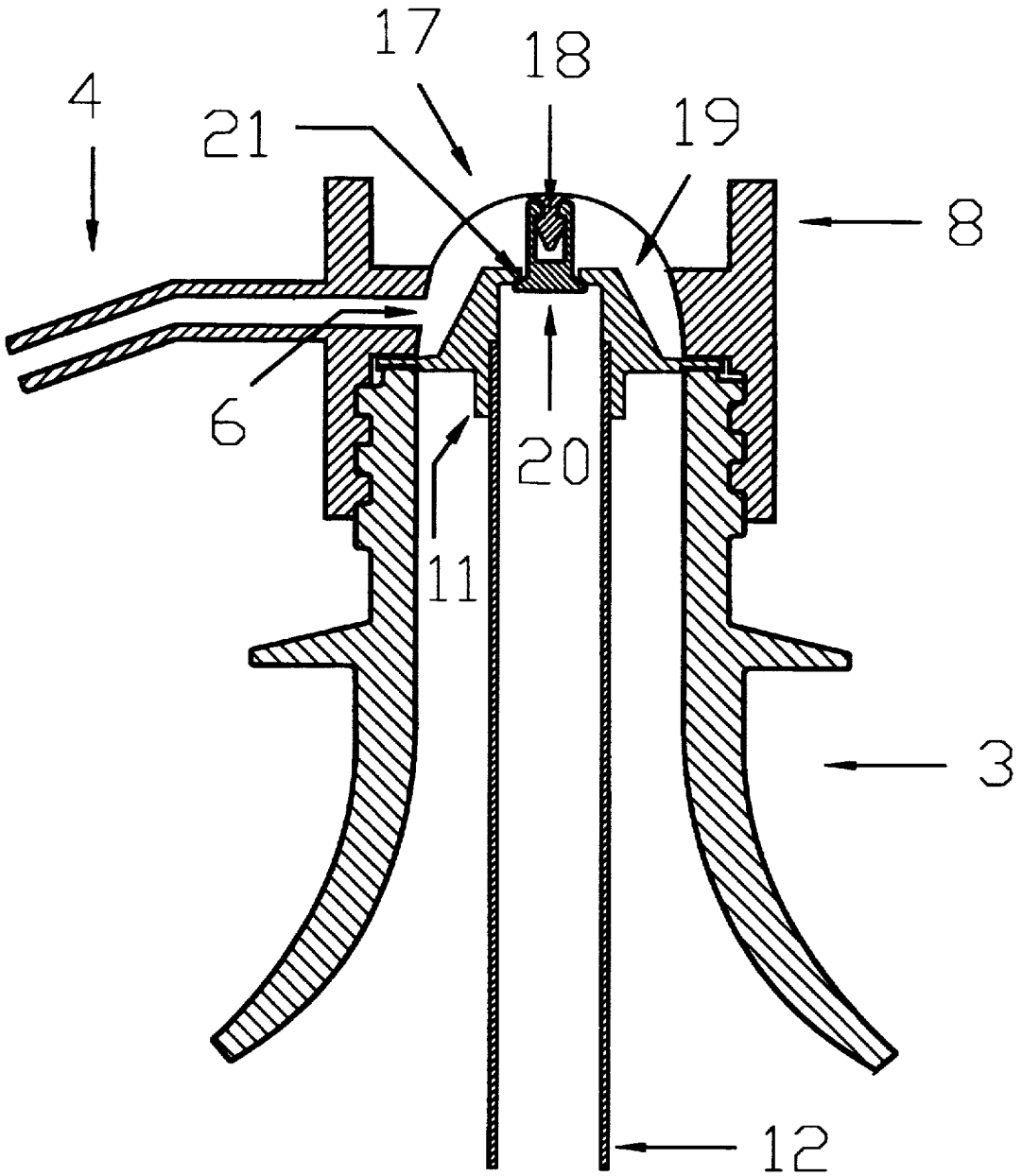
FIG. 9 illustrates another embodiment of the soda bottle cap of the present invention. The plug type seal (19) has a plug hole (21) in the center and the shell has a plug type flexible top (17) that has a plug holder (18) in the center which holds a plug (20).

FIG. 9 shows another example of the soda bottle cap of the invention. The plug type seal (19) has a plug hole (21) in the center and the shell has a plug type flexible top (17) that has a plug holder (18) in the center which holds a plug (20). Even when the spout is open, the liquid can not flow out because the plug (20) is pushed tightly against the plug hole (21) due to the high pressure of $CO_2$ gas in the soda bottle.

Figure 10:
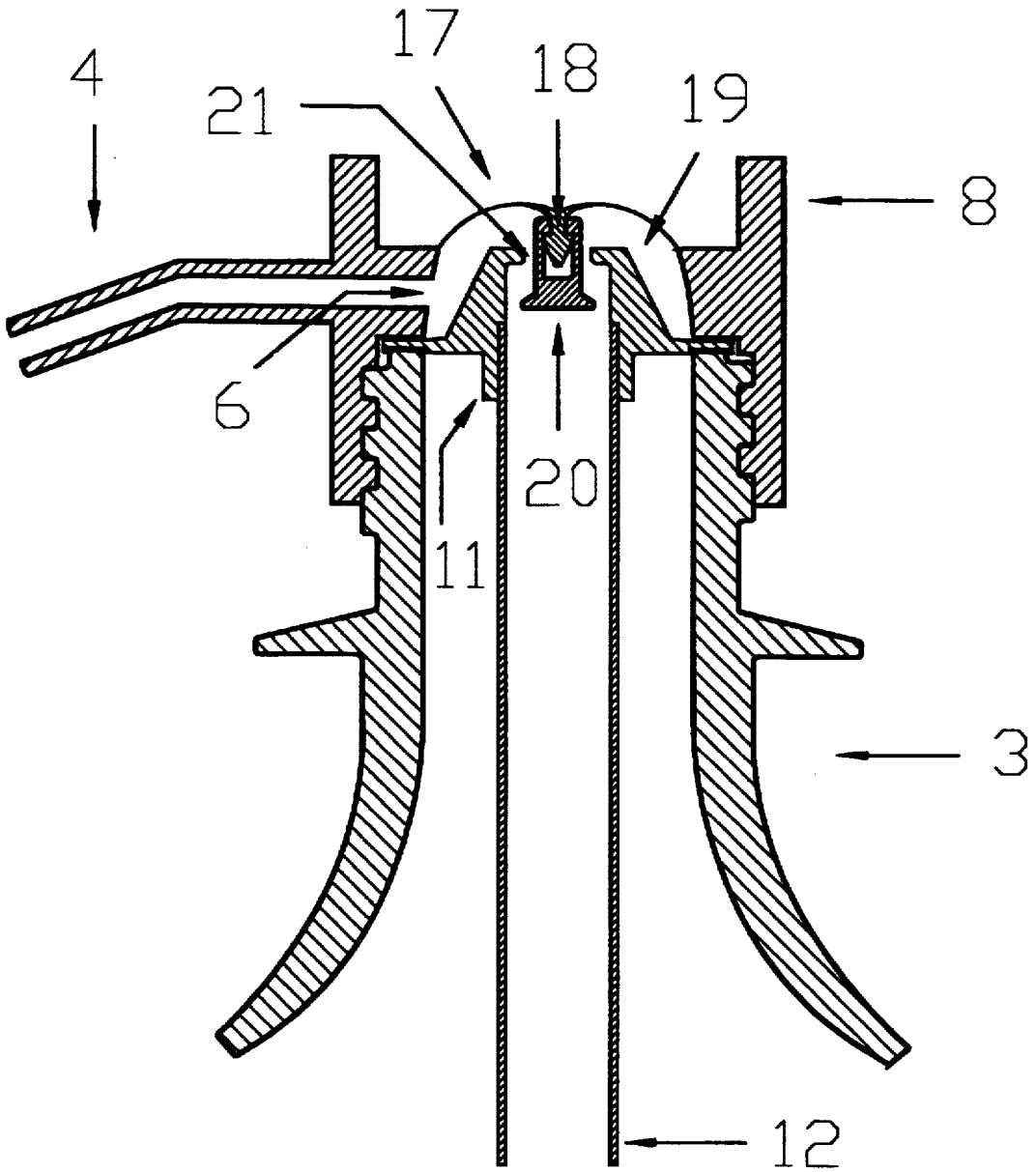
FIG. 10 illustrates the shape change of the soda bottle cap that was described in the FIG. 9, when the plug type flexible to (17) is pressed down.

FIG. 10 shows the shape change of the soda bottle cap that was described in FIG. 9, when the plug type flexible top (17) is pressed down. As the plug (20) is pushed down and does not block the plug hole (21) any more, the liquid in the soda bottle can be pushed out through the tube (12), and then through the plug hole (21) of the seal, and then through the inner hole (6) of the shell, and then through the spout (4) of the shell by the high internal pressure of the bottle. As the force on the plug type flexible top (17) is released, the plug type flexible top returns to the original shape due to its own elasticity and due to the high internal pressure, and the plug (20) held by the plug holder (18) is raised against the plug hole (21) and then pushed tightly against the plug hold due to the high pressure of $CO_2$ gas in the soda bottle, and the liquid can not flow out any more.

Figure 11:
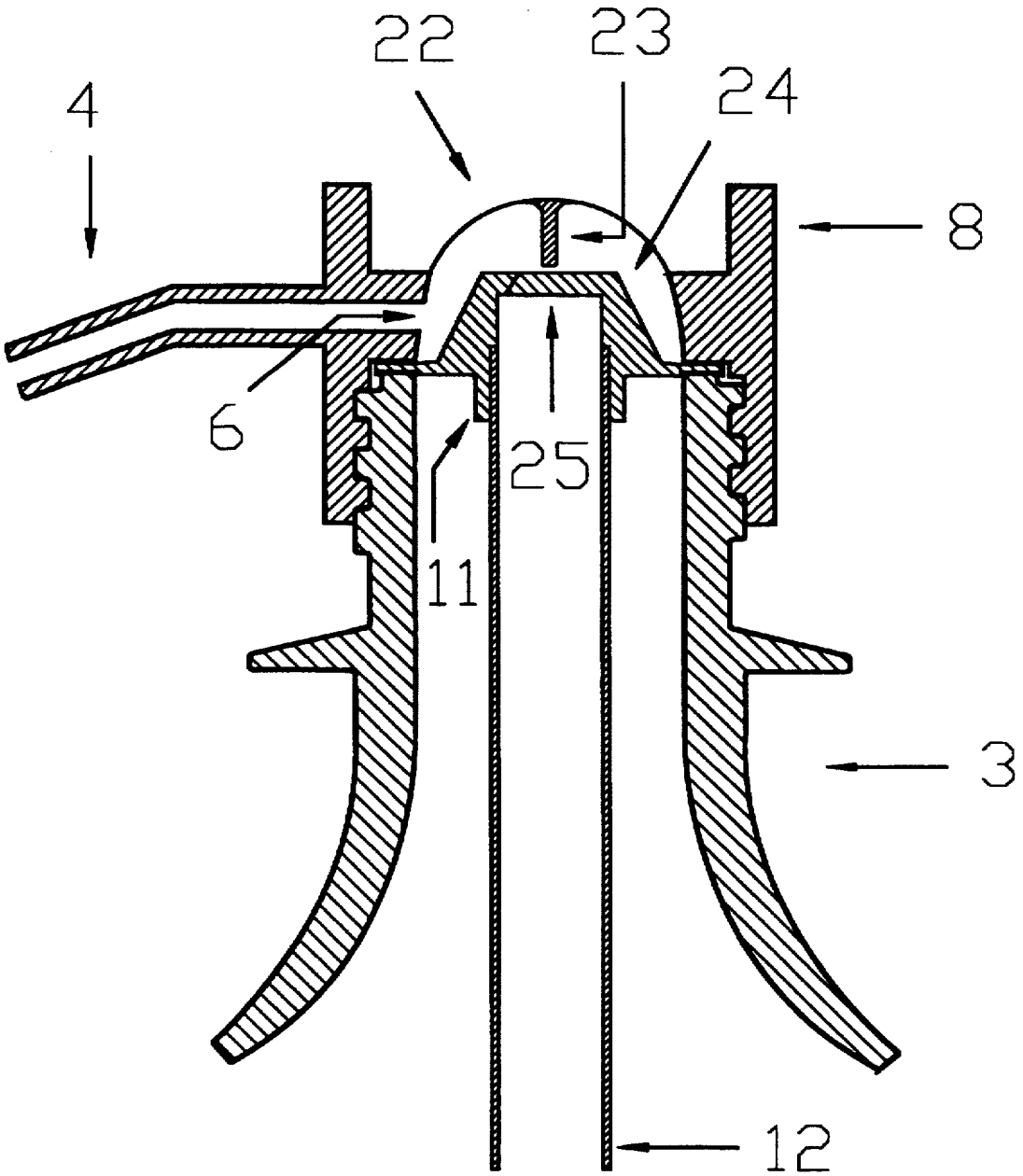
FIG. 11 shows another embodiment of the soda bottle cap of the invention. The lid valve type seal (24) has a lid valve (25) in the center.

FIG. 11 shows another example of the soda bottle cap of the invention. The lid valve type seal (24) has a lid valve (25) in the center which was formed by slant cut. As the lid valve (25) is pushed tightly against the lid valve type seal (24) due to the high pressure of $CO_2$ gas in the soda bottle, the liquid can not flow out even when the spout is open.

Figure 12:
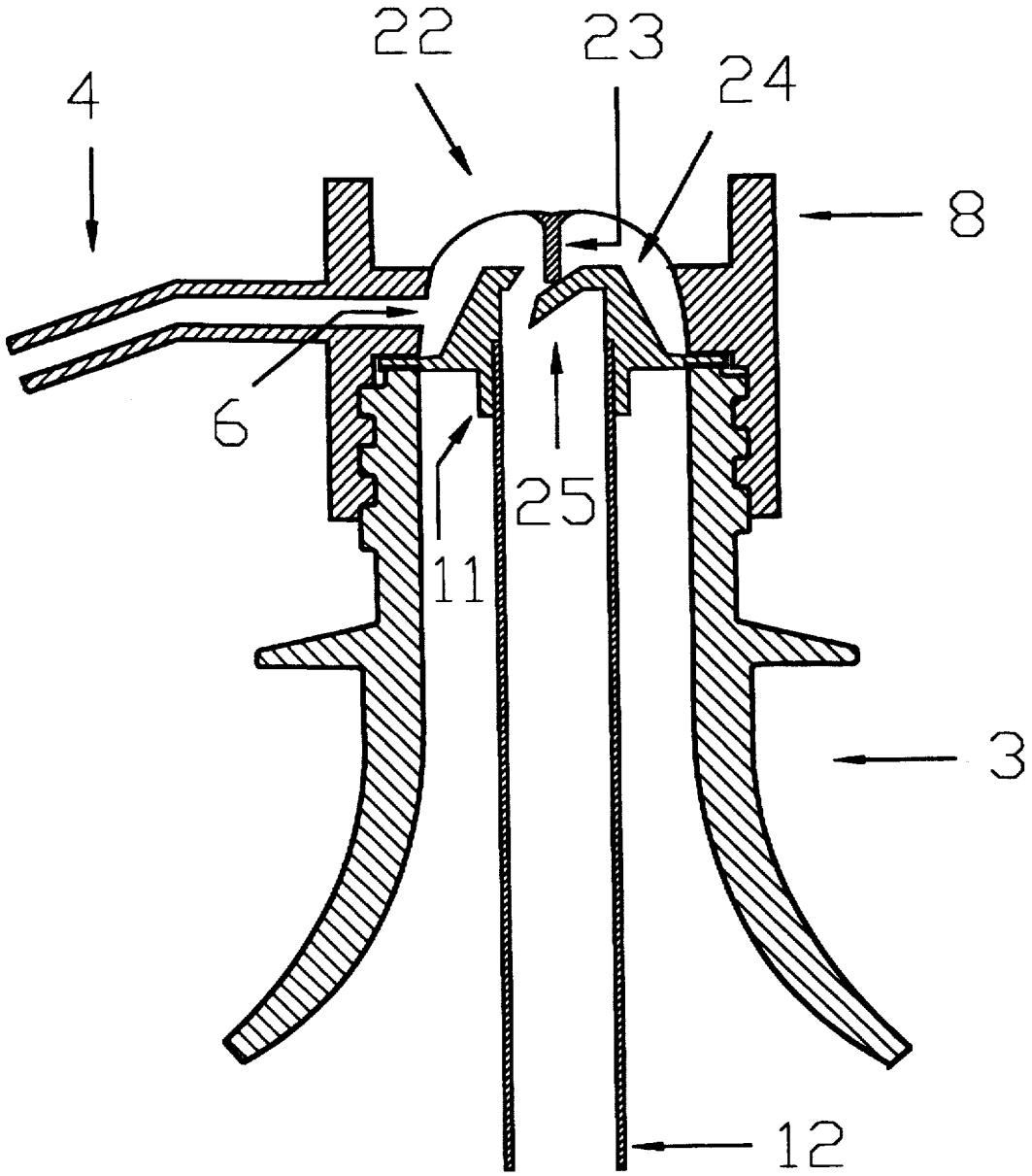
FIG. 12 shows the shape change of the soda bottle cap that was described in the FIG. 11, when the lid valve type flexible top (22) is pressed down. The liquid in the soda bottle can be pushed out through the opening of the lid valve type seal (24) by the high internal pressure of the bottle.

FIG. 12 shows the shape change of the soda bottle cap that was described in the FIG. 11, when the lid valve type flexible top (22) is pressed down. As the lid valve (25) is pushed down by the rod (23) that is formed downward at the center of the lid valve type flexible top (22) and the lid valve (25) does not close the lid valve type seal (24) any more, the liquid in the soda bottle can be pushed out through the type (12), and then through the opening of the lid valve type seal (24), and then through the inner hole (6) of the shell, and then through the spout (4) of the shell by the high internal pressure of the bottle. As the force on the lid valve type flexible top (22) is released, the lid valve type flexible top (22) returns to the original shape due to its own elasticity and due to the high internal pressure, and the lid valve (25) that was pressed down by the rod (23) returns to the original shape and then pushed tightly against the lid valve type seal (24) due to the high pressure of $CO_2$ gas in the soda bottle, and the liquid can not flow out any more.

BEST MODE FOR CARRYING OUT THE INVENTION

The soda bottle cap comprising a shell that has a flexible top (7), a protective shoulder (8), a spout (4), a notch (5) on the spout, a thread near the notch, a spout cap at the end of the spout, a triangular inner hole (15), and a ridge around the triangular inner hole, and a compliant seal that has a center hole (9), channels (10), a tube holder (11), and ribs (16) should be the best combination to carry out this invention as it has simple structure and therefore can be made for low cost. After the spout cap is detached along the notch, it can be used to close the spout for further safekeeping. Also, the soda bottle cap can be used without the tube (12) to prevent accidental discharge of liquid when the flexible top is pressed down by mistake. In this case the soda bottle cap and bottle assembly should be held upside down when the flexible top is pressed to discharge the liquid from the bottle.

Applicability

As the soda bottle cap of this invention has simple structure, it can be mass produced for low cost. Therefore, it can be widely used on carbonated liquid bottles to maintain the carbonated taste of the liquid until it is consumed.

We claim:

1. A soda bottle cap including a shell and a seal, comprising:

said shell having a flexible top, a protective shoulder disposed around said flexible top, and a spout having a closed end and a notch on the spout for breaking said closed end easily before use, said shell further having an inner hole that connects to said spout.

said seal having a center hole having a longitudinal axis, ribs, a tube holder for holding a tube aligned along the longitudinal axis of said center hole, and channels defined above said tube holder, said seal being made of compliant material so that said seal can be pressed against said inner hole by an internal pressure of a soda bottle when there is no force on said flexible top of the shell and so that the seal can be bent down and separated from the inner hole of the shell when the flexible top is pressed down so that fluid can flow out from said center hole and through said channels of said seal.

2. The soda bottle cap as defined in claim 1 wherein said shell has a triangular inner hole and ridge around the triangular inner hole.

3. A soda bottle cap according to claim 1 further including a shell, a plug, and a seal comprising said shell having a flexible top having a center and a plug holder in said center that holds a plug and presses down the plug to form an opening at the plug hole of the seal when the flexible top is pressed down, a protective shoulder around the flexible top, a closed end spout, a notch on the spout to break the end of the spout before use, and an inner hole that connects to the spout, and the seal has a plug hole and a tube holder.

4. A soda bottle cap according to claim 1 further comprising said seal having a lid valve in its center, the tube holder, and the shell having a flexible top that has a downward rod that can press down and open the lid valve of the seal when the flexible top is pressed down, the protective shoulder around the flexible top, a closed end spout, a notch on the spout to break the end of the spout easily before use, and an inner hole that connects to the spout.

5. The soda bottle cap as defined in claim 1, wherein the said spout has a male thread formed near the notch towards the body of the shell and a spout cap with female thread formed at the end of the spout so that the spout cap can be used to close the end of the spout for further safekeeping after the spout cap is detached from the spout at the notch.

6. The soda bottle cap as claimed in claim 3 wherein the spout has a male thread formed near the notch towards the body of the shell and a spout cap with female thread formed at the end of the spout so that the spout cap can be used to close the end of the spout for further safekeeping after the spout cap is detached from the spout at the notch.

7. The soda bottle cap as claimed in claim 4 wherein the spout has a male thread formed near the notch towards the body of the shell and a spout cap with female thread formed at the end of the spout so that the spout cap can be used to close the end of the spout for further safekeeping after the spout cap is detached from the spout at the notch.

* * * * *